US005868385A

United States Patent [19]

Embry et al.

[11] Patent Number: 5,868,385

[45] **Date of Patent: *Feb. 9, 1999**

[54] MEDIA FEED ARM WITH DIRECTIONAL DAMPING

[75] Inventors: Kerry Leland Embry; John Anthony Schmidt, both of Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 819,227

[22] Filed: Mar. 17, 1997

[51] Int. Cl.[6] ..... B65H 3/06

[52] U.S. Cl. ..... 271/118

[58] Field of Search ..... 271/117, 118

[56] References Cited

U.S. PATENT DOCUMENTS

| | | | |
|---|---|---|---|
| 3,507,488 | 4/1970 | Yanagawa | 271/36 |
| 4,934,686 | 6/1990 | Ono et al. | 271/117 |
| 5,085,420 | 2/1992 | Sata | 271/114 |
| 5,265,859 | 11/1993 | Watson et al. | 271/117 |
| 5,527,026 | 6/1996 | Padget et al. | 271/21 |
| 5,624,109 | 4/1997 | Tanaka | 271/118 |

FOREIGN PATENT DOCUMENTS

| | | | |
|---|---|---|---|
| 0 680 903 A1 | 11/1995 | European Pat. Off. | B65H 3/06 |
| 0 792 827 A2 | 9/1997 | European Pat. Off. | B65H 3/06 |
| 1-156241 | 6/1989 | Japan | B65H 3/06 |
| 405 301 645 | 11/1993 | Japan | 271/118 |

OTHER PUBLICATIONS

IBM Technical Disclosure Bulletin, Dec. 1981, vol. 24, No. 7B, pp. 3763–3764, System for Minimizing Solenoid Requirements.

IBM Technical Disclosure Bulletin, Sep. 1975, vol. 18, No. 4, pp. 955–956, Mechanical Picker Lift Mechanism.

IBM Technical Disclosure Bulletin, May, 1980, vol. 22, No. 12, pp. 5265–5266, Solinoid Rebound Damper.

*Primary Examiner*—H. Grant Skaggs
*Attorney, Agent, or Firm*—John A. Brady

[57] ABSTRACT

Bracket (1) containing a gear train holds the end of spring (19) wound in a direction to be opened when the bracket moves up from the paper tray (7). Spring (19) is wound on an arbor (15) which is mounted on a shaft (9) which is located on the pivot axis of the bracket. Spring (17) is wound on a second part of the arbor in a direction to be closed when the bracket moves away from the tray. Spring (19) has a much tighter grip on the arbor than spring (17). In operation the bracket resists upward movement under the influence of stiff paper being fed, and is slowed in its downward movement to reduce bounce, which increases the speed at which a second sheet can be fed.

9 Claims, 5 Drawing Sheets

MEDIA FEED ARM WITH DIRECTIONAL DAMPING

TECHNICAL FIELD

This invention relates to paper and other media feeders with pick rollers mounted on an arm and to the damping of bounce of the arm.

BACKGROUND OF THE INVENTION

In U.S. Pat. No. 5,527,026 to Padget et al., assigned to the assignee to which this invention is assigned, a paper feed mechanism is disclosed in which pick rollers are driven by a gear train mounted on a arm which is free to pivot around the center of the driven gear of the gear train. This construction automatically applies increasing force on the pick roller until the pick roller moves paper, at which point the downward pressure is automatically relieved.

In practice using the foregoing construction heavy paper lifts the gear train as the paper is fed, thereby causing the gear train to drop under the influence of gravity as such paper or other media leaves the drive roller. This causes bouncing of the drive roller and thus the gear train, which slows reliable operation. This invention is directed to the addition of a damping mechanism which largely restricts the lifting movement, and which slows the dropping on to the paper stack.

DISCLOSURE OF THE INVENTION

In accordance with this invention a bracket having the pick gear train is fixed to the end of a first spring wound in a direction to be opened when the bracket moves away from the media tray. That spring is wound around a first cylindrical part of an arbor, and the arbor is mounted for rotation on a shaft which is located on the axis of pivot of the gear train. A second spring is wound on a second cylindrical part of the arbor in a direction to be closed when the bracket moves away from the media tray. The end of the second spring is fixed to a stationary frame. The first spring has a much tighter friction grip on the arbor than the second spring.

In operation, as the driven gear of the drive train is operated for paper picking with the pick roller against the top of the media stack, downward movement is minimal, as is the relatively low friction of the second spring, so the influence of the first and second springs is not material. Upon movement of paper off of the stack, the downward force of the gear train is automatically relieved. Upward movement of the gear train tightens the second spring around an arbor which thereby grips the arbor and causes the arbor to rotate with the rotation of the gear train. If the paper is relatively stiff, an upward force is applied to the gear train, but upward movement is resisted by the high friction of the first spring, limiting the upward movement. This permits the media to move away more smoothly.

The gear train is left unsupported after such upward movement when the media moves past the drive roller. The gear train will then return toward the tray under the influence of gravity. The downward movement tightens the first spring around the arbor which thereby grips the arbor and causes the arbor to rotate with the rotation of the gear train. That downward movement opens the grip of the second spring on the arbor, permitting slipping of the arbor on the second spring. In the embodiment disclosed the light friction grip of the second spring on the arbor results in relatively low friction, which moderately damps the downward movement and reduces bounce. A low friction is desirable since the gear train is also counterbalanced by a spring. The drive roller is thereby settled for driving media much more quickly than if the bounce were not damped.

Where the downward friction is not significant, a single spring may be employed wrapped around a stationary shaft, wound to unwind on upward movement and function as described for the first spring.

BRIEF DESCRIPTION OF THE DRAWING

The details of this invention will be described in connection with the accompanying drawing, in which.

BEST MODE FOR CARRYING OUT THE INVENTION

Figure 1:
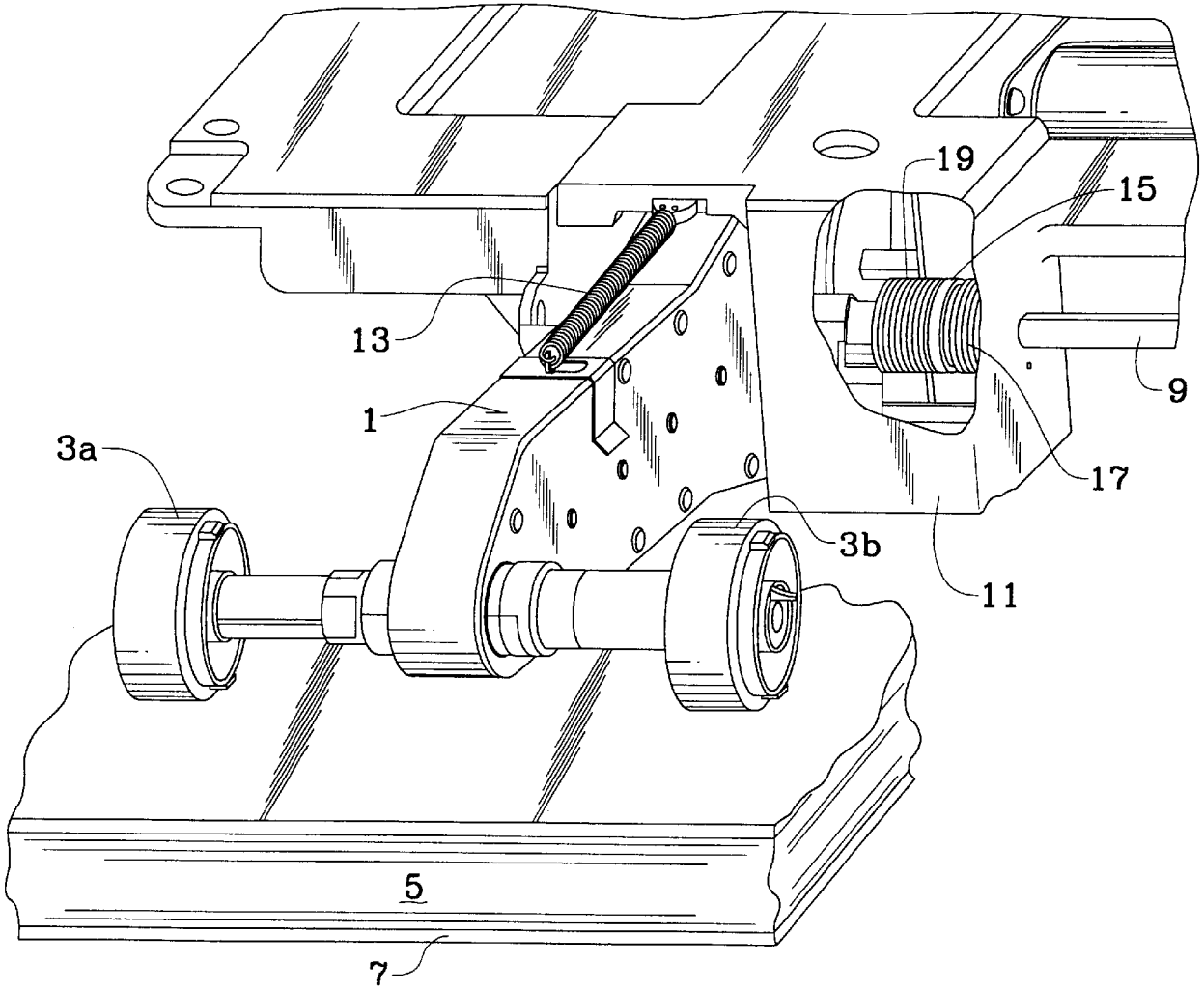
FIG. 1 illustrates the damped pick arm from a top perspective view with the arm down as it would be when it rests on a stack of paper.

As shown in FIG. 1 a bracket 1 which contains a train of gears (shown in FIG. 5) drives symmetrical drive rollers 3*a,* 3*b* which contact the top of a stack of paper or other media 5. Paper 5 rests on a flat tray 7, which may be stationary or may be elevated for large stacks of media 5. Bracket 1 is mounted to pivot around a driven gear, as is described in the foregoing U.S. Pat. No. 5,527,026. A shaft 9 is mounted in a stationary frame 11 and is coaxial with the pivot point of bracket 1.

Coil spring 13 is connected between bracket 1 and frame 11 to provide an upward, counterbalance force to bracket 1, which, however, does not overcome the force of gravity. Bracket 1 therefore is constructed to drop under the force of gravity, at an acceleration reduced by the force of spring 13 until rollers 3*a,* 3*b* encounter paper 5.

Figure 2:
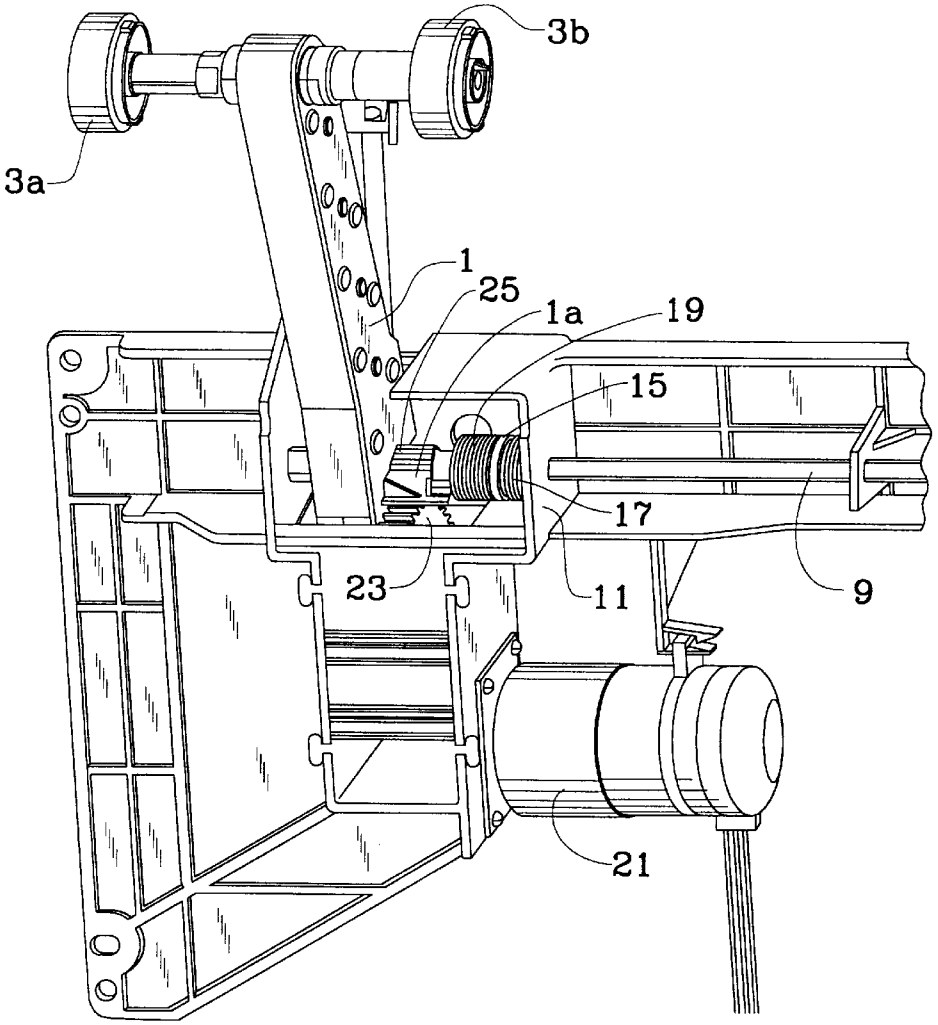
FIG. 2 is a bottom view of the same configuration as FIG. 1.

The broken away section of FIG. 1 shows arbor 15 having a spring 19 wrapped on the side of arbor 15 near bracket 1 and a spring 17 wrapped on the side of arbor 15 away from bracket 1. As better shown in FIG. 2, spring 19 has an end held in an extension la of bracket 1, and spring 17 has an end held in frame 11. FIG. 2 shows a motor 21 attached to frame 11 which drives a series of gears (only gears 23 and 25 shown) which drive the gear train in bracket 1.

Figure 3:
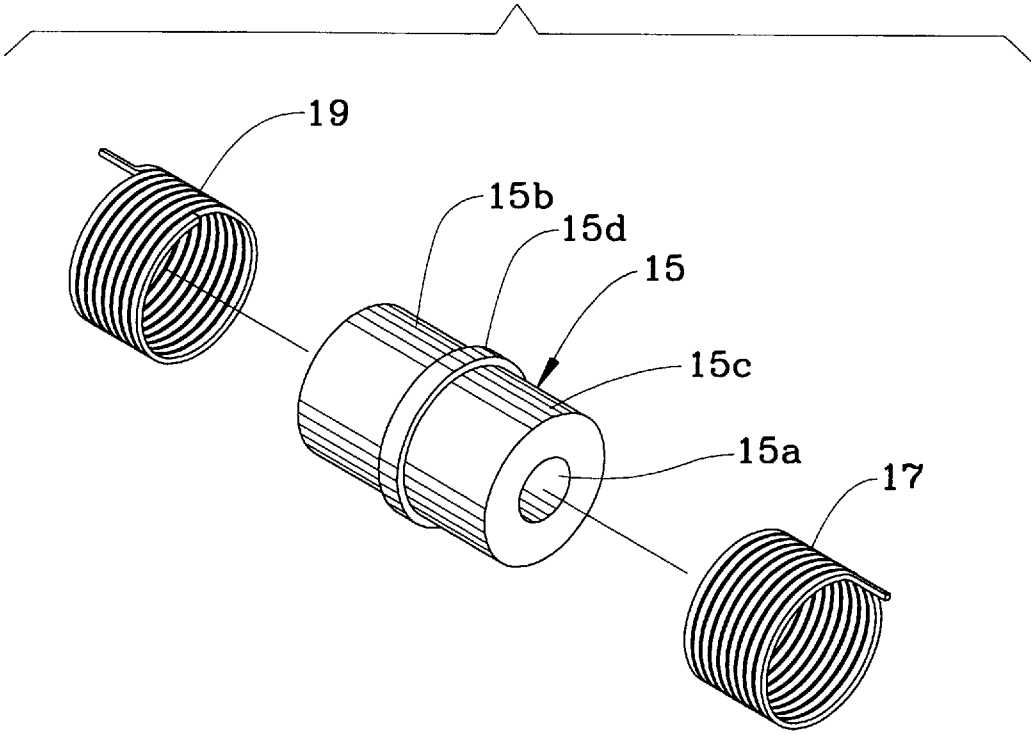
FIG. 3 illustrates the springs and arbor.

FIG. 3 shows in more detail the arbor 15 in exploded relationship with the springs 17 and 19 as they are installed. Arbor 15 has a central hole 15*a* which receives shaft 9 in a close, but not tight, fit. Arbor 15 has a left cylindrical part 15*b* and a right cylindrical part 15*c* and a central ridge 15*d*. In this embodiment the cylindrical parts 15*b* and 15*c* are the same diameter. Springs 17 and 19 in this embodiment are of identical material and cross section. However, spring 17 is loosely held by part 15*b* (specifically, with the outside diameter of arbor part 15*c* being nominally 14.17 mm and the inside diameter of spring 17 being nominally 14.08 mm) Spring 19 is much more tightly held by part 15*b* (specifically with the outside diameter of arbor part 15*c* being also nominally 14.17 mm and the inside diameter of spring 17 being nominally 13.75 mm).

Figure 4:
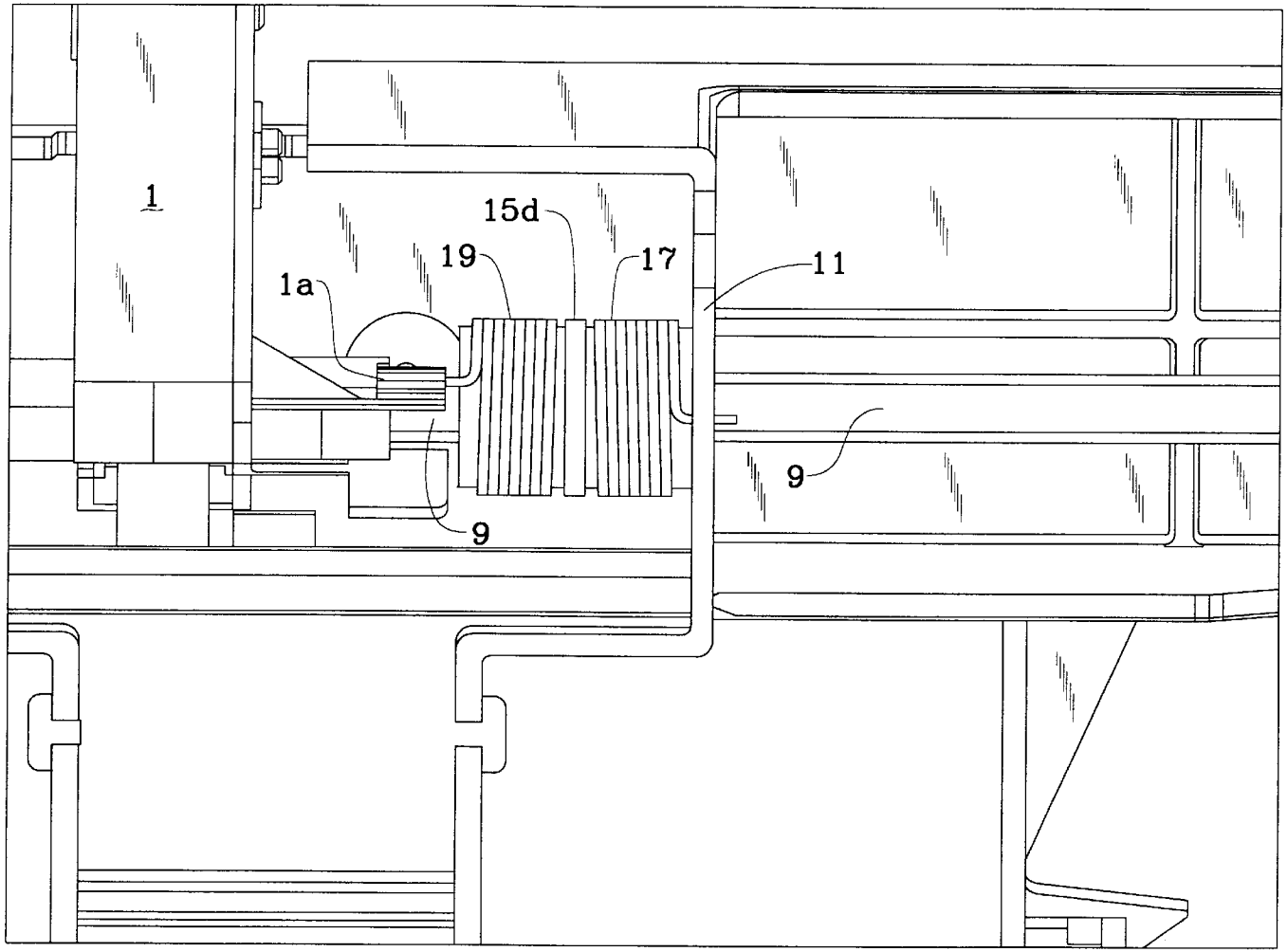
FIG. 4 is a bottom view with the arm lifted as it would be by stiff paper being fed.
Figure 5:
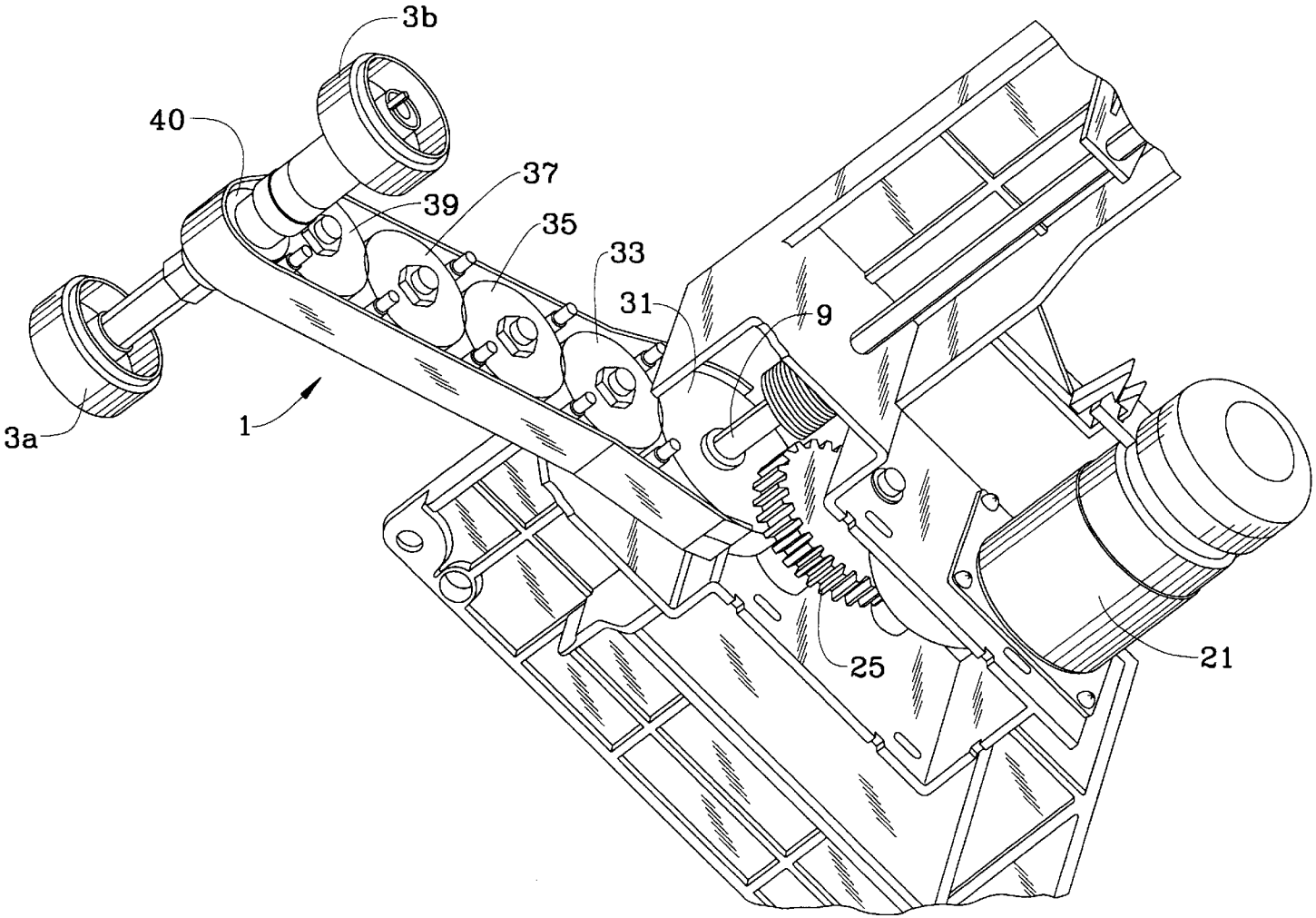
FIG. 5 illustrates the gears of the gear train.

FIG. 4 is a bottom view showing the assembly when bracket 1 is moved upward away from media 5. This tends to occur in operation when stiff paper or other media 5 is fed. During such feeding media 5 is grasped by feed rollers or the like (not shown) downstream of bracket 1, which apply sufficient moving force for the media 5 to lift bracket 1 upward. Comparison of FIG. 1 and FIG. 5 illustrates the spring 19 is unwound by the upward movement toward FIG. 4 position. The upward movement tightens spring 17 in the manner of a standard spring clutch to cause arbor 15 to move with bracket 1. The unwinding of spring 19 results in slippage of spring 19 around arbor 15, and the friction is relatively high since spring 19 is tightly wound around arbor 15. Bracket 1 is moved upward, but in an amount restricted by the friction of spring 19.

As the media 5 is moved, bracket 1 will cease to be held up by media 5 and bracket 1 will then move down toward tray 7 under the influence of gravity. This movement will tighten spring 19 in the manner of a standard spring clutch. The tightened spring 19 will grasp arbor 15 and force it to rotate with bracket 1. That rotation of arbor 15 will tend to unwind spring 17. Spring 17 being lightly wound on arbor 15, the friction drag of spring 17 on arbor 15 will be moderate, thereby damping the movement of bracket 1 and shortening the time to when bracket 1 is settled in place and another feeding of media 5 can occur. Moderate friction is appropriated as bracket 1 is counterbalanced by spring 13, which also reduces downward movement of bracket 1.

FIG. 5 illustrates the gears in bracket 1 by removal of one side of bracket 1. Driven gear 31 is driven by motor 21 through gear 25 and is journaled on shaft 9. Rotation of gear 31 on shaft 9 permits bracket 1 to rotate as has been described. A gear train exists of gear 31 which drives gear 33. Gear 33 drives gear 35. Gear 35 drives gear 37. Gear 37 drives gear 39, and gear 39 drives gear 41, which drives rollers 3*a* and 3*b*. (Rollers 3*a* and 3*b* are driven through a one-way clutch so as to move freely when downstream rollers move media 5 faster than the driven speed of rollers 3*a* and 3*b*.)

It will be apparent that the parts of arbor 15 on which the springs 17 and 19 are wound may differ in diameter or the springs 17 and 19 may differ in composition or cross section since the essential design feature is that spring 17 provide sufficient friction to limit downward movement of the gear train and spring 19 provide significant friction to limit upward movement of the gear train, while both springs 17 and 19 be effective to grasp and turn arbor 5 when each spring 17 or 19 is tightened.

It will also be apparent that if the downward restraint of the spring 17 is not deemed needed, spring 17 could be replaced with a one-way ratchet mechanism. Also, the ends of springs 17 and 19 could be wrapped tightly around stationary extensions, rather than having spring ends fitting in holes. Other variations will be apparent or can be anticipated which are consistent with this invention as described.

What is claimed is:

1. A media feed apparatus comprising a frame of said apparatus, a tray for holding media to be fed by said apparatus on said tray, a bracket for carrying a gear train mounted to pivot toward and away from said tray around an axis concentric with the driven gear of said gear train, at least one media feed roller mounted on said bracket for rotation by said gear train, a shaft mounted to said frame with the center of said shaft concentric with said driven gear, and a spring wound around a rotatable element, and having an end fixed to said bracket, said spring being wound to be unwound when said bracket moves away from said tray, said spring being in sufficient frictional contact with said element to apply frictional drag to said element when said bracket moves away from said tray to resist upward movement of said bracket.

2. A media feed apparatus comprising a frame of said apparatus, a tray for holding media to be fed by said apparatus on said tray, a bracket for carrying a gear train mounted to pivot toward and away from said tray around an axis concentric with the driven gear of said gear train, at least one media feed roller mounted on said bracket for rotation by said gear train, a shaft mounted to said frame with the center of said shaft concentric with said driven gear, an arbor mounted on said shaft on a central hole of said arbor, said arbor having a first cylindrical part near said bracket and a second cylindrical part, a first spring wound on said first part of said arbor, having an end fixed to said bracket, and wound to be unwound when said bracket moves away from said tray, said first spring being in sufficient frictional contact with said first part of said arbor to apply frictional drag to said arbor when said bracket moves away from said tray to resist upward movement of said bracket, and a second spring wound on said second part of said arbor, having an end fixed to said frame, and wound to be further wound when said bracket moves away from said tray.

3. The media feed apparatus as in claim 2 in which said second spring is wound in light contact with said second part of said arbor to apply sufficient frictional drag to said arbor when said bracket moves toward said tray to reduce bounce of said bracket.

4. The media feed apparatus as in claim 3 in which said first part of said arbor and said second part of said arbor have substantially the same outer diameter and said first spring is wound in a tight fit around said first part of said arbor.

5. The media feed apparatus as in claim 2 in which said first part of said arbor and said second part of said arbor have substantially the same outer diameter and said first spring is wound in a tight fit around said first part of said arbor.

6. A media feed apparatus comprising a frame of said apparatus a tray for holding media to be fed by said apparatus on said tray, a bracket for carrying a gear train mounted to pivot toward and away from said tray around an axis concentric with the driven gear of said gear train, at least one media feed roller mounted on said bracket for rotation by said gear train, a shaft mounted to said frame with the center of said shaft concentric with said driven gear, an arbor mounted on said shaft on a central hole of said arbor, said arbor having a first cylindrical part near said bracket and a second cylindrical part, a first spring wound on said first part of said arbor, having an end fixed to said bracket, a second spring wound on said second part of said arbor, having an end fixed to said frame, one of said first spring and said second spring being wound to be unwound when said bracket moves away from said tray and being in sufficient frictional contact with said part of said arbor on which said one spring is wound to apply frictional drag to said arbor when said bracket moves away from said tray to resist upward movement of said bracket, and the other of said first spring and said second spring being wound to be further wound when said bracket moves away from said tray.

7. The media feed apparatus as in claim 6 in which said other spring is wound in light contact with said arbor to apply sufficient frictional drag to said arbor when said bracket moves toward said tray to reduce bounce of said bracket.

8. The media feed apparatus as in claim 7 in which said first part of said arbor and said second part of said arbor have substantially the same outer diameter and said one spring is wound in a tight fit around said arbor.

9. The media feed apparatus as in claim 6 in which said first part of said arbor and said second part of said arbor have substantially the same outer diameter and said one spring is wound in a tight fit around said arbor.

* * * * *